US007943096B2

(12) United States Patent
Kurth et al.

(10) Patent No.: US 7,943,096 B2
(45) Date of Patent: May 17, 2011

(54) CALIBRATED CATALYST CARRIER BODY WITH CORRUGATED CASING

(75) Inventors: Ferdi Kurth, Mechernich (DE); Udo Schmidt, Neunkirchen (DE)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 320 days.

(21) Appl. No.: 12/140,300

(22) Filed: Jun. 17, 2008

(65) Prior Publication Data

US 2008/0247919 A1 Oct. 9, 2008

Related U.S. Application Data

(60) Division of application No. 10/967,713, filed on Oct. 18, 2004, now Pat. No. 7,404,254, which is a continuation of application No. PCT/EP03/04047, filed on Apr. 17, 2003.

(30) Foreign Application Priority Data

Apr. 18, 2002 (DE) ..... 102 17 260
Apr. 26, 2002 (DE) ..... 102 18 856

(51) Int. Cl.
*B01D 50/00* (2006.01)

(52) U.S. Cl. ..... 422/180

(58) Field of Classification Search ..... 422/177, 422/179, 180

See application file for complete search history.

(56) References Cited

U.S. PATENT DOCUMENTS 4,163,042 A 7/1979 Lynch
4,519,120 A 5/1985 Nonnenmann et al.
4,677,839 A 7/1987 Retallick
4,803,189 A 2/1989 Swars
4,832,998 A 5/1989 Cyron
4,923,109 A 5/1990 Cyron
4,946,822 A 8/1990 Swars
5,105,539 A 4/1992 Maus et al.
5,118,476 A 6/1992 Dryer et al.

(Continued)

FOREIGN PATENT DOCUMENTS

DE 88110869 U1 12/1988

(Continued)

OTHER PUBLICATIONS

Japanese Office Action dated Jan. 13, 2009.

(Continued)

*Primary Examiner* — Tom Duong
(74) *Attorney, Agent, or Firm* — Laurence A. Greenberg; Werner H. Stemer; Ralph E. Locher

(57) ABSTRACT

A method for manufacturing a catalyst carrier body includes producing a honeycomb body having at least partially structured layers forming channels through which a fluid can flow. The honeycomb body has an external extent formed at least partially by ends of the layers. At least one corrugated casing and a housing are also produced. The honeycomb body is inserted into the corrugated casing and the corrugated casing with the honeycomb body is inserted into the housing with the housing at least partially surrounding the honeycomb body. The housing is calibrated by reducing at least an internal contour of the housing and preferably also a profile of the corrugated casing. The honeycomb body is connected to the housing with the corrugated casing disposed between the honeycomb body and the housing. A catalyst carrier body produced by the method is also provided.

18 Claims, 4 Drawing Sheets

U.S. PATENT DOCUMENTS

| | | | | |
|---|---|---|---|---|
| 5,135,794 | A | | 8/1992 | Maus et al. |
| 5,137,696 | A | | 8/1992 | Hitachi et al. |
| 5,139,844 | A | | 8/1992 | Maus et al. |
| 5,157,010 | A | | 10/1992 | Maus et al. |
| 5,272,875 | A | | 12/1993 | Kaji |
| 5,329,698 | A | | 7/1994 | Abbott |
| 5,346,675 | A | | 9/1994 | Usui et al. |
| 5,651,906 | A | * | 7/1997 | Whittenberger et al. ..... 219/552 |
| 6,036,926 | A | | 3/2000 | Wieres |
| 6,145,195 | A | | 11/2000 | Wieres |
| 6,258,328 | B1 | | 7/2001 | Torkkell et al. |
| 6,368,726 | B1 | | 4/2002 | Holpp et al. |
| 6,673,466 | B2 | | 1/2004 | Brück et al. |
| 2003/0049484 | A1 | | 3/2003 | Brück et al. |
| 2003/0086838 | A1 | | 5/2003 | Bruck et al. |

FOREIGN PATENT DOCUMENTS

| | | | |
|---|---|---|---|
| DE | 3743723 | C1 | 4/1989 |
| DE | 3833675 | A1 | 4/1990 |
| DE | 4310933 | A1 | 10/1994 |
| DE | 19821249 | A1 | 11/1998 |
| EP | 0245737 | A1 | 11/1987 |
| JP | 5587815 | A | 7/1980 |
| JP | 57055886 | B | 11/1982 |
| JP | 62-273051 | A | 11/1987 |
| JP | 1-203044 | A | 8/1989 |
| JP | 2268834 | A | 11/1990 |
| JP | 2-303087 | A | 12/1990 |
| JP | 3-28774 | U | 3/1991 |
| JP | 3-502660 | A | 6/1991 |
| JP | 04222636 | | 8/1992 |
| JP | 622683 | B | 3/1994 |
| JP | 7024331 | A | 1/1995 |
| JP | 7303841 | A | 11/1995 |
| JP | 8-196918 | A | 8/1996 |
| JP | 9174184 | A | 7/1997 |
| JP | 9-262438 | A | 10/1997 |
| JP | 11-253815 | A | 9/1999 |
| JP | 2000-312073 | A | 11/2000 |
| JP | 2001-289041 | A | 10/2001 |
| WO | 90/03220 | | 4/1990 |
| WO | 99/03220 | A1 | 4/1990 |
| WO | 9008249 | A1 | 7/1990 |
| WO | 01/94761 | A1 | 12/2001 |

OTHER PUBLICATIONS

English translation of Japanese Office Action dated Mar. 23, 2010.

* cited by examiner

CALIBRATED CATALYST CARRIER BODY WITH CORRUGATED CASING

CROSS-REFERENCE TO RELATED APPLICATION

This is a divisional application of application Ser. No. 10/967,713, filed Oct. 18, 2004, now U.S. Pat. No. 7,404,254 which was a continuation, under 35 U.S.C. §120, of international application No. PCT/EP03/04047, filed Apr. 17, 2003, which designated the United States; this application also claims the priority, under 35 U.S.C. §119, of German patent application 102 17 260.9, filed Apr. 18, 2002, and German patent application 102 18 856.4, filed Apr. 26, 2002; the prior applications are herewith incorporated by reference in their entirety.

BACKGROUND OF THE INVENTION

Field of the Invention

The present invention relates to a catalyst carrier body including a honeycomb body which has at least partially structured layers with ends that form channels through which a fluid can flow. A housing at least partially surrounds the honeycomb body. At least one corrugated casing is disposed between the honeycomb body and the housing and connects the honeycomb body to the housing. The invention also relates to a method for manufacturing the catalyst carrier body. Such catalyst carrier bodies are used in particular to reduce the proportion of pollutants in exhaust gases of mobile internal combustion engines.

Catalyst carrier bodies are used in exhaust systems of mobile internal combustion engines (for example diesel engines or spark ignition engines). For that purpose, the catalyst carrier bodies are usually provided with a support layer (in particular a wash coat) which is distinguished by a very large surface and is usually impregnated with at least one catalytically active material (for example platinum, rhodium or the like). When the exhaust gas is in contact with those catalytically active materials, the pollutants contained in the exhaust gas, for example carbon monoxide, unsaturated hydrocarbons, nitrogen monoxide, are reduced. The catalyst carrier bodies are usually embodied as honeycomb bodies which have a large number of channels through which a fluid can flow, in order to be able to make available a relatively large surface for the support layer. In that context, ceramic, extruded and metallic honeycomb bodies are known. The honeycomb bodies are generally introduced into a housing which is in turn integrated directly into the exhaust line. In such a mobile exhaust system, the catalyst carrier body is subjected to high thermal and dynamic stresses.

The thermal stresses result, for example, on one hand from the temperature of the exhaust gas itself. That temperature increases if the catalyst carrier body is disposed closer to the internal combustion engine. On the other hand, the chemical catalytic conversion also brings about an increase in the temperature of the catalyst carrier body since the conversion generally takes place in an exothermal manner so that under certain circumstances temperatures are reached which are significantly higher than the exhaust gas temperature itself. The important factors regarding the dynamic stresses result from the combustion process and external excitation of oscillations. Since the combustion process in the internal combustion engines takes place intermittently, the resulting pressure surges are propagated periodically through the exhaust system. External excitation of oscillation takes place, for example, due to unevennesses in the underlying surface over which the motor vehicle is traveling. Due to those high thermal and dynamic stresses, a permanent connection of the honeycomb to the housing is of particular interest. That connection must be suitable, on one hand, for compensating different thermal expansion behavior of the honeycomb body with respect to the housing, and on the other hand the honeycomb body must be prevented from becoming detached from the housing over the long term.

It is known, particularly with respect to the use of metallic honeycomb bodies and their permanent connection to a metallic housing, to connect the honeycomb body to the housing through the use of an intermediate layer which is connected on its internal side to the honeycomb body and on its external side to the housing. Such an intermediate layer is disclosed, for example, in Japanese Patent Application No. 04-222 636 A. In that publication, the intermediate layer is embodied as a piece of corrugated sheet metal and is connected to the honeycomb body on one side and to the housing on the other side. In that context it is stated that the piece of corrugated sheet metal can become deformed when the honeycomb body expands radially. In order to ensure such deformation it is proposed in that publication that a connection of the piece of corrugated sheet metal to the honeycomb body should not be disposed in the same cross section as a connection to the housing. It is claimed that expansion and contraction in the axial direction of the honeycomb body are also ensured under those circumstances. The honeycomb body described in that publication is composed of a smooth piece of sheet metal and a corrugated piece of sheet metal which are rolled together in the shape of a spiral to form a cylindrical honeycomb body. In that context, the external boundary of the honeycomb body is formed by a smooth piece of sheet metal. If that requirement is fulfilled, coupling the piece of corrugated sheet metal which is used for the coupling to the housing is relatively unproblematic since a virtually smooth surface of the honeycomb body is provided.

However, such a spiral-shaped structure of the honeycomb body has a number of disadvantages with respect to fabrication and long-term behavior. During the manufacturing process it is difficult to provide the individual layers with a uniform prestress so that close contact between the adjacent sheet metal layers with one another cannot be reliably ensured. That leads, for example, to a situation in which such honeycomb bodies have a tendency to undergo what is referred to as telescoping when subjected to prolonged thermal and dynamic stresses. That means that the layers become displaced with respect to one another after a certain period of use. That leads to a nonhomogenous structure which can ultimately also result in the failure of the component.

For that reason, other configurations of the sheet metal foils have already been previously used. Those configurations include, in particular, honeycomb bodies which are formed from a large number of smooth and corrugated metal foils that are bent in an S shape and/or U shape. For a more detailed description of such metallic honeycomb bodies, reference is made, in particular, to European Patent Application 0 245 737 A1, corresponding to U.S. Pat. Nos. 4,946,822, 4,803,189, 4,832,998 and 4,923,109; International Publication No. WO 90/03220, corresponding to U.S. Pat. Nos. 5,135,794, 5,105,539 and 5,139,844; and German Patent DE 37 43 723 C1, the disclosures of which are completely incorporated herein by reference. However, with such configurations of the honeycomb body, the honeycomb body is not bounded by a smooth position but instead a large number of free ends of the smooth and corrugated sheet metal layers are disposed on the periphery of the honeycomb body.

SUMMARY OF THE INVENTION

It is accordingly an object of the invention to provide a calibrated catalyst carrier body with a corrugated casing and a method for manufacturing the same, which overcome the hereinafore-mentioned disadvantages of the heretofore-known products and methods of this general type, in which the method ensures a permanent connection, using a joining technique, of the honeycomb body to a corrugated casing that is disposed between the housing and the honeycomb body. In this case, the emphasis is in particular on a permanent coupling between the free ends of the individual layers of the honeycomb body and the corrugated casing. In addition, the method is intended to ensure that it can be carried out easily within the scope of series fabrication. Furthermore, the catalyst carrier body should ensure a stable coupling between the honeycomb body and the corrugated casing even under high thermal and dynamic stresses. The preferred manner of using the joining technique is by brazing. However, a sintering process or even welding may be used as well.

With the foregoing and other objects in view there is provided, in accordance with the invention, a method for manufacturing a catalyst carrier body. The method comprises producing a honeycomb body having at least partially structured layers forming channels through which a fluid can flow. The layers have ends and the honeycomb body has an external extent formed at least partially by the ends of the layers. At least one corrugated casing with a profile and a housing with an internal contour are also produced. The honeycomb body is inserted into the at least one corrugated casing. The at least one corrugated casing with the honeycomb body is inserted into the housing, with the housing at least partially surrounding the honeycomb body. The housing is calibrated or sized by reducing at least the internal contour of the housing and preferably the profile of the at least one corrugated casing as well. The honeycomb body is connected to the housing with the at least one corrugated casing disposed between the honeycomb body and the housing.

The honeycomb body is preferably manufactured in the manner which is described, for example, in European Patent Application 0 245 737 A1, corresponding to U.S. Pat. Nos. 4,946,822, 4,803,189, 4,832,998 and 4,923,109; International Publication No. WO 90/03220, corresponding to U.S. Pat. Nos. 5,135,794, 5,105,539 and 5,139,844; and German Patent DE 37 43 723 C1. In this respect, the honeycomb body has a plurality of free ends which form the external extent. The honeycomb body preferably has more than four free ends near to its external extent. The term "external extent" is intended herein to describe substantially the distance between surfaces of the honeycomb body lying opposite one another. The external extent thus corresponds, for example, to the diameter of the honeycomb body if the latter has a substantially cylindrical construction. Due to the fact that such honeycomb bodies can, however, basically also be manufactured with an oval or polygonal cross section or with a conical shape, the term "extent" is intended to form a parameter which also describes these cross-sectional shapes.

Furthermore, at least one corrugated casing is manufactured with a profile. This is usually done in such a way that a smooth piece of sheet metal is provided with a structure, for example through the use of two intermeshing rolling gearwheels, is cut to size with the desired dimensions and the ends are subsequently connected to one another. The term "profile" is to be understood herein in turn as the distance between sides of the corrugated casing which lie opposite one another in the assembled state so that again reference is not made solely to the diameter when there is a cylindrical configuration of the corrugated casing. In view of the fact that the corrugated casing has a structure, "peaks" and "troughs" are present, and the term "profile" preferably means the distance between a peak and the trough lying opposite.

The manufacture of the housing with an internal contour also includes, for example, the manufacture of a cylindrical housing. The "internal contour" describes in this case in turn the distance between the internal surfaces of the housings which lie opposite, since these surfaces are decisive for the coupling of the honeycomb body or of the corrugated casing.

An important aspect of the method according to the invention is the calibration, standardization or sizing of the housing after the insertion of the honeycomb body and the at least one corrugated casing. During such calibration, at least the internal contour, that is to say the distance between the internal faces lying opposite, of the housing, is reduced. This is preferably brought about through the use of forces acting on the housing from the outside. For example, plastic deformations of the housing, in particular through the use of a pressure roller or similar tools, are suitable for this purpose. The calibration of the housing generally brings about a deformation or displacement of the corrugated casing, as a result of which close contact between the free ends of the honeycomb body and the corrugated casing as well as between the corrugated casing and the housing is ensured. The profile of the at least one corrugated casing is also preferably reduced within the scope of such a calibration process. As a result, the structure of the corrugated casing is changed in the process, and the free ends of the layers which form the honeycomb body "click" into this structure and bear virtually completely against the corrugated casing. As a result, ends which flap about freely and which, on one hand, it may be impossible to connect to the corrugated casing by joining techniques and, on the other hand, easily tend to tear off later due to the high dynamic stress in the exhaust system, are avoided. Due to this calibration process and the common deformation of the housing and of the at least one corrugated casing (and of the honeycomb body as well if appropriate), close contact is provided, and this is a precondition for a complete coupling of the layers of the honeycomb body to the at least one corrugated casing, as well of the corrugated casing to the housing.

As an alternative, or in addition, to the mechanical calibration, it is also possible under certain circumstances to calibrate the housing through the use of a thermal shrinking process. As a result, the calibration processes can always detect or sense one another due to specific surface structures of the housing and/or changes in structure of the material itself, even if these components are subsequently also subjected to thermal treatment, in particular to the formation of connections through the use of a joining technique.

In accordance with another mode of the invention, the profile of the at least one corrugated casing and/or the internal contour of the housing is larger than the extent of the honeycomb body. The profile and/or the internal contour is preferably between 0.2 mm and 2 mm larger than the external extent of the honeycomb body, in particular between 0.3 mm and 1.2 mm. In this way, it is possible to prevent the situation in which, when the honeycomb body is inserted into the corrugated casing or when the corrugated casing is subsequently inserted, with the honeycomb body, into the housing, the free ends of the honeycomb body become "jammed" or fixed in such a way that adaptation to the structure of the corrugated casing does not take place, or does not occur to the desired extent, during the subsequent calibration process.

Within the scope of technical pre-trials it has become apparent that it is particularly advantageous to match the different dimensions of the components to the structure used for the at least one corrugated casing. In accordance with a further mode of the invention, in this regard it is also proposed that the at least one corrugated casing have a structure with a structure length and a structure height, and the profile of the at least one corrugated casing and/or the internal contour of the housing be larger than the external extent of the honeycomb body by approximately the value of the structure height. The structure of the corrugated casing may be embodied in different ways in this case. This structure usually has a corrugated, sinusoidal, rectangular or trapezoidal shape or a similar form. Structure length is intended in this case to refer to the distance between a "peak" and a "trough" which is disposed adjacent it in the circumferential direction of the corrugated casing. The structure height describes herein the perpendicular distance, with respect to the circumferential direction, between adjacent peaks and troughs. In this context it is to be noted that in particular when a plurality of corrugated casings are used which may possibly be spaced apart from one another axially it is also possible to use structures which are different from one another and have different structure lengths and/or structure heights. These structures then are generally adapted to the corresponding thermal and dynamic stresses of the honeycomb body. It is also possible to use different structures with a refinement of the catalyst carrier body having a plurality of corrugated casings which are superimposed one on the other, or engage one in the other, in the radial direction.

In accordance with an added mode of the invention, the honeycomb body is manufactured in such a way that the layers are each alternately built up from a smooth layer and a corrugated layer or from different corrugated layers, are then stacked and subsequently bent and/or wound into an S shape and/or U shape so that the ends of the layers at least partially bound the external extent of the honeycomb body. The alternating configuration between a smooth layer and a corrugated layer results in an increased stability of the honeycomb body itself. In this way it is also possible to ensure a virtually complete connection of adjacent layers to one another since the smooth layer always provides a uniformly level or easily bent bearing surface for the peaks and troughs, thus ensuring sufficient contact regions for the layers to be connected to one another later through the use of a joining technique. The corrugated layer generally also has a structure of the type mentioned above, with the channels being formed by the alternate stacking of smooth layers and corrugated layers and being later provided with a catalytically active support layer. In this case, the structure of the corrugated layer preferably extends perpendicularly to an axis of the honeycomb body so that the channels are embodied substantially parallel to this axis. A honeycomb body which is manufactured in this way generally has a channel density of from 400 cpsi (cells per square inch) to 1600 cpsi.

In accordance with an additional mode of the invention, due to the calibration, the ends of the layers move into engagement with a structure of the at least one corrugated casing, and the layers come to bear in particular against the at least one corrugated casing. In this configuration it is advantageous in particular that at least 90% of the free ends of the layers are in contact with the at least one corrugated casing. This preferably takes place over the entire axial length of the honeycomb body or of the layers.

In accordance with yet another mode of the invention, with respect to the refinement of the connections, through the use of a joining technique, between the at least one corrugated casing and the housing, it is proposed that the at least one corrugated casing be provided, before the insertion into the housing, with at least one brazing material strip which preferably serves to subsequently couple the at least one corrugated casing to the housing. Such brazing material strips or bands are particularly suitable for ensuring a defined bounded connection of the corrugated casing to the housing. The corrugated casing is preferably connected in this case to the housing in a region in which a comparatively small different thermal expansion behavior of the honeycomb body and housing is expected. Such a region is in particular to be located at some distance from the end sides of the honeycomb body (in particular from the end side from which the hot exhaust gas enters the catalyst carrier body) since, in particular during the heating and cooling behavior of the honeycomb body, it has a tendency to undergo barrel-shaped deformation during which particularly the end sides exhibit a significantly higher expansion behavior or contraction behavior than internal regions.

In accordance with yet a further mode of the invention, it is also advantageous to determine the width of the brazing material strip as a function of at least one of the following parameters:

(A) external extent of the honeycomb body;

(B) length of the honeycomb body;

(C) cell density of the honeycomb body; and (D) layer thickness of the layers.

The width of the brazing material strip depends in a monotonously increasing manner on one of the parameters (A), (B), (C) or (D) if the respective other three parameters (A), (B), (C), (D) are kept constant.

In accordance with yet an added mode of the invention, in this way, the width of the brazing material strip increases monotonously as the length of the honeycomb body increases, for example given catalyst carrier bodies with the same cell density, layer thickness and identical diameter in the case of cylindrical components. In this context, increasing monotonously means that although there may be honeycomb bodies of two lengths which include a brazing material strip of the same width given the same cell density, layer thickness and identical diameter, a honeycomb with a greater length than another honeycomb body cannot have a narrower brazing material strip.

Specifically, in the case of a cylindrical catalyst carrier body with a length of 74.5 mm, a diameter of 65 mm, a cell density of 600 cpsi ("cells per square inch") and a layer thickness of 0.025 mm (25 μm), the width of the brazing material strip is advantageously 4 mm. The width of the brazing material strip depends substantially linearly on the layer thickness given a constant cell density, constant diameter and constant matrix length, and a proportionality factor between 0.7 and 1.3 being preferably 1. Given a constant cell density, constant layer thickness and constant length of the honeycomb body, the width of the brazing material strip depends substantially linearly on the diameter of the cylindrical honeycomb body, and the proportionality factor also being between 0.7 and 1.3 in this case.

In accordance with yet an additional mode of the invention, the catalyst carrier body is provided over at least one end side with a brazing material which accumulates in regions where the layers are in contact with one another and/or with the at least one corrugated casing. This means that the catalyst carrier body is placed in contact in particular with a pulverulent brazing material at the end sides in the assembled state. For this purpose, it is advantageous under certain circumstances for the contact regions to be brazed to be firstly provided with an adhesive to which the brazing powder which is supplied at the end sides adheres. The adhesive is preferably also introduced over the end side of the assembled catalyst carrier body, the (liquid) adhesive being in fact disposed, in particular exclusively, in these contact regions due to a capillary effect. This also has, inter alia, the advantageous effect that the adhered number of brazing material grains can be set in a defined manner through the use of the quantity of adhesive supplied.

In accordance with still another mode of the invention, in particular if the intention is that a connection of the components to one another or, with regard to the honeycomb body, of the individual layers to one another is to be carried out in a way which is precisely limited (that is to say not over the entire axial length of the honeycomb body), it is proposed to provide a passivation before the brazing, which passivation bounds at least one brazing region. Such a passivation may, on one hand, include structural measures on the components themselves, for example the provision of microstructures or changes to the surface topography (roughening, etc.). However, it is, for example, also possible to apply or generate such a passivation in the form of an additional coating (metal oxides, ceramic coatings and the like) which also prevents the brazing material from flowing out over the passivation.

In accordance with still a further mode of the invention, the passivation is embodied at least partially as an air gap. The air gap advantageously interrupts the capillary force so that the brazing material and/or, if appropriate, an adhesive is prevented from flowing further out over the passivation. In this context it is advantageous to form the air gap through the use of a recess in the housing and/or a step in the corrugated casing and, if appropriate, a spacer between the housing and corrugated casing. It may be necessary to form the spacer in order to prevent the air gap from being closed solely by the stress of the honeycomb body before thermal treatment.

In accordance with still an added mode of the invention, a ceramic layer and/or a metal-oxide-containing layer is formed, as a spacer, on the external surface of the corrugated casing and/or the internal surface of the housing, with a thickness which corresponds substantially to the height of the air gap. In this way, the spacer is advantageously used to form an air gap which is as uniform as possible.

In accordance with still an additional mode of the invention, it is advantageous if the height of the air gap is 5 mm or less, preferably less than 2 mm.

In accordance with again another mode of the invention, the passivation is embodied at least partially in the form of at least one metallic foil.

In accordance with again a further mode of the invention, the at least one metallic foil is bonded to the corrugated casing or to the housing and at least partially overlaps the brazing material strip. This leads, after thermal treatment, to a situation in which, on one hand, the metallic foil is connected to the housing or the corrugated casing but on the other hand it is ensured that the connection of the housing to the corrugated casing is spatially limited. In particular, the metallic foil can be formed from the material from which the layers from which the honeycomb body is composed are manufactured. In this context it is advantageous that the at least one metallic foil is made thinner than 70 μm, preferably thinner than 50 μm, in particular preferably thinner than 30 μm.

In accordance with again an added mode of the invention, the catalyst carrier body should undergo thermal treatment which results in the layers being connected to one another, with the layers being connected to the at least one corrugated casing and/or the at least one corrugated casing being connected to the housing through the use of a joining technique. This includes, on one hand, a brazed connection of the individual components to one another. However, alternatively, welded connections or diffusion connections can alternatively or additionally be generated within the scope of the thermal treatment.

With the objects of the invention in view, there is also provided a catalyst carrier body, comprising a honeycomb body having at least partially structured layers with ends. The at least partially structured layers form channels through which a fluid can flow. A housing at least partially surrounds the honeycomb body. At least one corrugated casing is disposed between the honeycomb body and the housing and connects the honeycomb body to the housing. At least 90%, preferably at least 95% and in particular more than 98%, of the ends of the at least partially structured layers are connected to the at least one corrugated casing by a joining technique.

In accordance with another feature of the invention, all of the free ends of the honeycomb body are preferably connected to the corrugated casing. Such a catalyst carrier body is preferably manufactured according to a refinement of the method described above. As already explained, the close contact between the free ends of the honeycomb body and the at least one corrugated casing results in a significantly increased number of connections through the use of a joining technique, ensuring long-term deployment of such catalyst carrier bodies particularly in mobile exhaust systems. In this context, the ends are particularly preferably in contact with one another or connected to one another over the entire overlapping region between the honeycomb body and corrugated casing.

In accordance with a further feature of the invention, the catalyst carrier body includes metallic smooth layers and corrugated layers which are preferably disposed alternately and arc bent in an S shape and/or U shape so that all the ends at least partially form an external extent of the honeycomb body. In this context, the configuration of the layers with a layer thickness of less than 0.1 mm, in particular less than 0.05 mm and preferably less than 0.02 mm, is particularly preferred. The smooth layers and corrugated layers are composed in this case of a ferritic metal or a corresponding metal alloy which includes aluminum and chromium, in order to maintain corrosion resistance of the layers even at very high temperatures (operating temperatures of the catalyst carrier body up to 1300° C.). The proposed layer thickness causes the honeycomb body or the catalyst carrier body to have a relatively small surface-specific thermal capacity. The result of this is that the catalyst carrier body can quickly follow the rapidly changing ambient conditions due to different load changes of the internal combustion engine, ensuring that the catalytically initiated reactions start quickly, in particular when cold-starting the internal combustion engine.

In accordance with an added feature of the invention, the honeycomb body, the at least one corrugated casing and the housing have a cylindrical shape. The cylindrical shape has the advantage of permitting the catalyst carrier body to be integrated into the exhaust system itself in a relatively uncomplicated and easy manner without additional positioning aids.

In accordance with an additional feature of the invention, a connecting region of the at least one corrugated casing to the housing is smaller in area than a coupling region of the at least one corrugated casing to the honeycomb body, and the connecting region and the coupling region preferably at least partially overlap. The configuration of a catalyst carrier body in which the coupling region extends over the entire axial length of the honeycomb body is particularly preferred. The connecting region between the corrugated casing and the housing is embodied as a narrow peripheral strip (having a width of less than 10 mm, preferably less than 6 mm, particularly preferably less than or equal to 4 mm) in the center of the catalyst carrier body. However, under certain circumstances it may also be advantageous for the corrugated casing to be coupled to the honeycomb body only over narrow regions near to the end sides of the honeycomb body. However, in the last-mentioned configuration, it is preferred to maintain the central configuration of the connecting region with respect to the coupling of the corrugated casing to the housing.

In accordance with still another feature of the invention, it is also advantageous to configure the catalyst carrier body in such a way that the width of the connecting region depends on at least one of the following parameters:

(A) external extent of the honeycomb body;

(B) length of the honeycomb body;

(C) cell density of the honeycomb body; and (D) layer thickness of the layers.

The width of the connecting region depends in a monotonously increasing manner on one of the parameters (A), (B), (C) or (D) if the respective other three parameters (A), (B), (C), (D) are kept constant.

In accordance with still a further feature of the invention, it is advantageous to make the width of the connecting region variable since catalyst carrier bodies with different external extents, lengths, cell densities or layer thicknesses make different requirements on the coupling between the housing and corrugated casing. In particular, these parameters influence the possible barrel-shaped deformation of the honeycomb body, which makes different widths of the connecting region advantageous. The statements made above with respect to the width of the brazing material strip apply in the same way to the width of the connecting region, and vice versa.

In accordance with still an added feature of the invention, the connecting region is bounded axially by an air gap. In this context, it is particularly advantageous to form the air gap through the use of a recess in the housing and/or a step in the corrugated casing and, if appropriate, to form the spacer between the housing and the corrugated casing.

In accordance with still an additional feature of the invention, with respect to the dimensioning of the catalyst carrier body, it is proposed that the casing thickness of the at least one corrugated casing should lie, in terms of its size, between the layer thickness of the layers and the housing thickness of the housing, in particular in a range from 0.08 mm to 0.25 mm. The result of this is that the corrugated casing has a surface-specific thermal capacity which lies between the surface-specific thermal capacity of the layers and that of the housing. In this regard, a corrugated casing which is embodied in this way is particularly suitable for compensating the different thermal expansion behaviors of the layers and of the housing. The at least one corrugated casing and preferably also the housing are manufactured in this case from the same material or from a similar material as the layers of the honeycomb body.

In accordance with yet another feature of the invention, the honeycomb body has a length in the direction of an axis which corresponds to an extent of the corrugated casing in the direction of the axis. While the length of the honeycomb body, the extent of the corrugated casing and the dimension of the housing in the direction of the axis are generally freely variable, in the embodiment proposed herein the corrugated casing ends flush with the end sides of the honeycomb body. This is advantageous in particular with respect to the fabrication and in particular the positioning of the at least one corrugated casing with respect to the honeycomb body.

In accordance with a concomitant feature of the invention, the at least one corrugated casing should have a structure length and a structure height, wherein the structure length lies in the range from 1.5 mm to 3.5 mm, and the structure height is preferably 0.3 mm to 1 mm. A corrugated casing which is embodied in this way ensures, on one hand, sufficient expansion or contraction of the honeycomb body in the axial, radial or circumferential directions and on the other hand also ensures that the free ends of the layers "click in" and untreated exhaust gas is prevented from flowing past during the later deployment of the catalyst carrier body in the exhaust system of mobile internal combustion engines.

Other features which are considered as characteristic for the invention are set forth in the appended claims.

Although the invention is illustrated and described herein as embodied in a calibrated catalyst carrier body with a corrugated casing and a method for manufacturing the same, it is nevertheless not intended to be limited to the details shown.

Various modifications and structural changes may be made in the invention without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
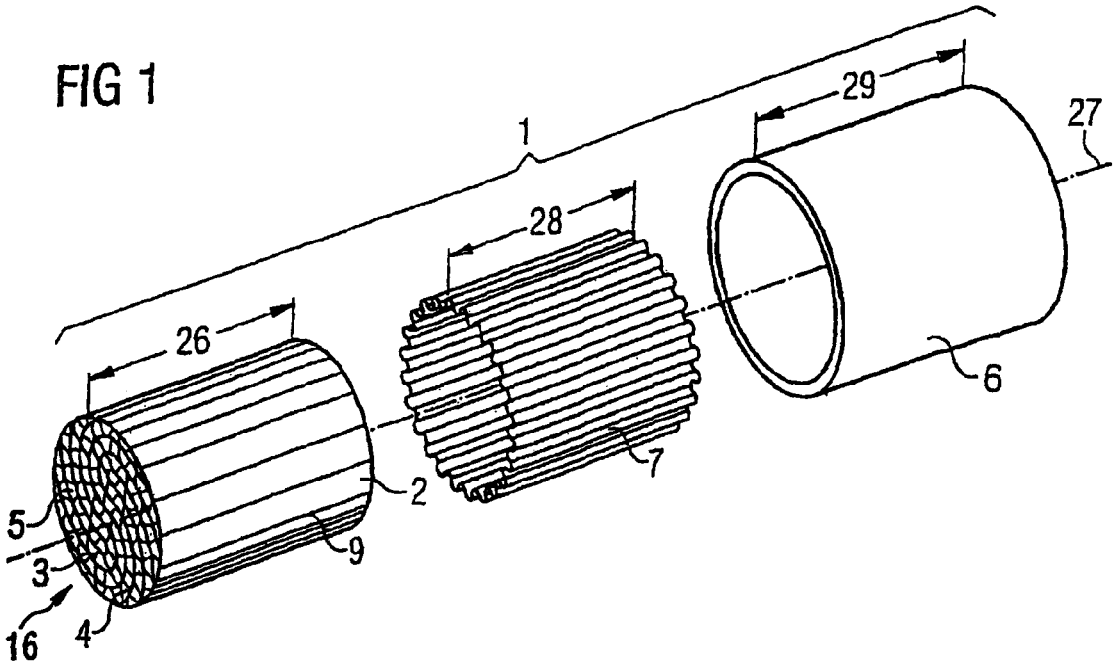
FIG. 1 is a diagrammatic, exploded, perspective view of an embodiment of a catalyst carrier body according to the invention.

Referring now to the figures of the drawings in detail and first, particularly, to FIG. 1 thereof, there is seen an exploded, perspective view of an embodiment of a catalyst carrier body 1 according to the invention, including a honeycomb body 2, a corrugated casing 7 which is disposed concentrically with respect to the honeycomb body 2 and with respect to an axis 27, as well as a housing 6 that is also disposed concentrically. The honeycomb body 2 has a cylindrical construction in this case and includes a plurality of corrugated layers 3 and smooth layers 4 which are disposed or stacked and/or wound in such a way that their ends 9 at least partially form a periphery of the cylindrically constructed honeycomb body 2. Due to the alternating configuration of corrugated layers 3 and smooth layers 4, channels 5 are formed through which an exhaust gas can flow. In the illustrated embodiment of the honeycomb body 2, the channels 5 extend from one end side 16 to the opposite end side 16 over the entire length 26 of the honeycomb body 2. The channels 7 are formed substantially parallel to the axis 27.

An extent 28 of the corrugated casing 7 of the illustrated catalyst carrier body 1 corresponds substantially to the length 26 of the honeycomb body 2. In this case, the corrugated casing 7 is folded or reverse drawn over the honeycomb body 2 in such a way that the edges of the corrugated casing 7 are disposed substantially flush with the end sides 16 of the honeycomb body 2. The illustrated housing 6 also has a dimension 29 in the direction of the axis 27 which corresponds substantially to the extent 28 of the corrugated casing 7 and to the length 26 of the honeycomb body 2. The result of this is that in the assembled state, the catalyst carrier body 1 exhibits a virtually flush configuration of the honeycomb body 2, corrugated casing 7 and housing 6.

Figure 2:
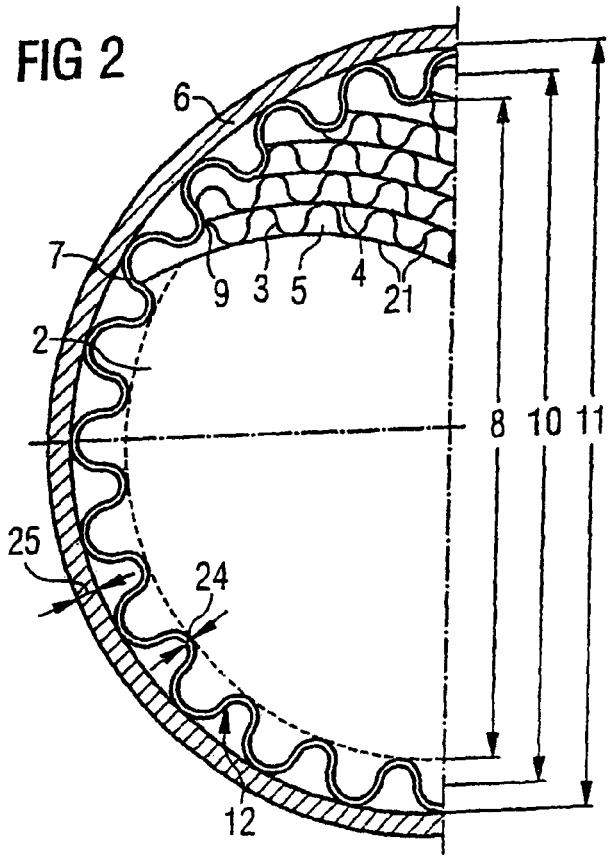
FIG. 2 is an enlarged, fragmentary, sectional view of an embodiment of the catalyst carrier body.

FIG. 2 shows half of a cross section through an embodiment of the catalyst carrier body 1. It is apparent in this case that the honeycomb body 2 is surrounded by the corrugated casing 7 which is in turn surrounded by the housing 6. The corrugated layers 3 and smooth layers 4 which form the channels 5 through which the exhaust gas can flow are indicated in the upper region of this illustration. The corrugated layers 3 and smooth layers 4 each have a layer thickness 21 which is preferably in the region of 0.05 mm and 0.015 mm. From this illustration it is apparent that an external extent 8 of the honeycomb body 2 is formed at least partially by the ends 9 of the corrugated layers 3 and smooth layers 4.

The illustrated embodiment relates to a catalyst carrier body 1 having a housing 6 which has already been calibrated, standardized or sized. This is apparent from the fact that at least 90% of the ends 9 of the layers 3, 4 is in contact with the corrugated casing 7 or connected to it by a joining technique. This could be brought about by the extent of the internal contour 11 of the housing 6 and the extent of the profile 10 of the corrugated casing 7 having been reduced as a result of this calibration process and at the same time a structure 12 of the corrugated casing 7 having been deformed or displaced. The ends 9 of the layers 3, 4 are then automatically adjusted in such a way that they now bear against the inside of the corrugated casing 7, ensuring a permanent connection of the honeycomb body 2 to the corrugated casing 7 through the use of a joining technique. In this case, the corrugated casing 7 has a casing thickness 24 which lies between the layer thickness 21 of the corrugated layers 3 and smooth layers 4, on the one hand, and a housing thickness 25 of the housing 6, on the other hand.

Figure 3:
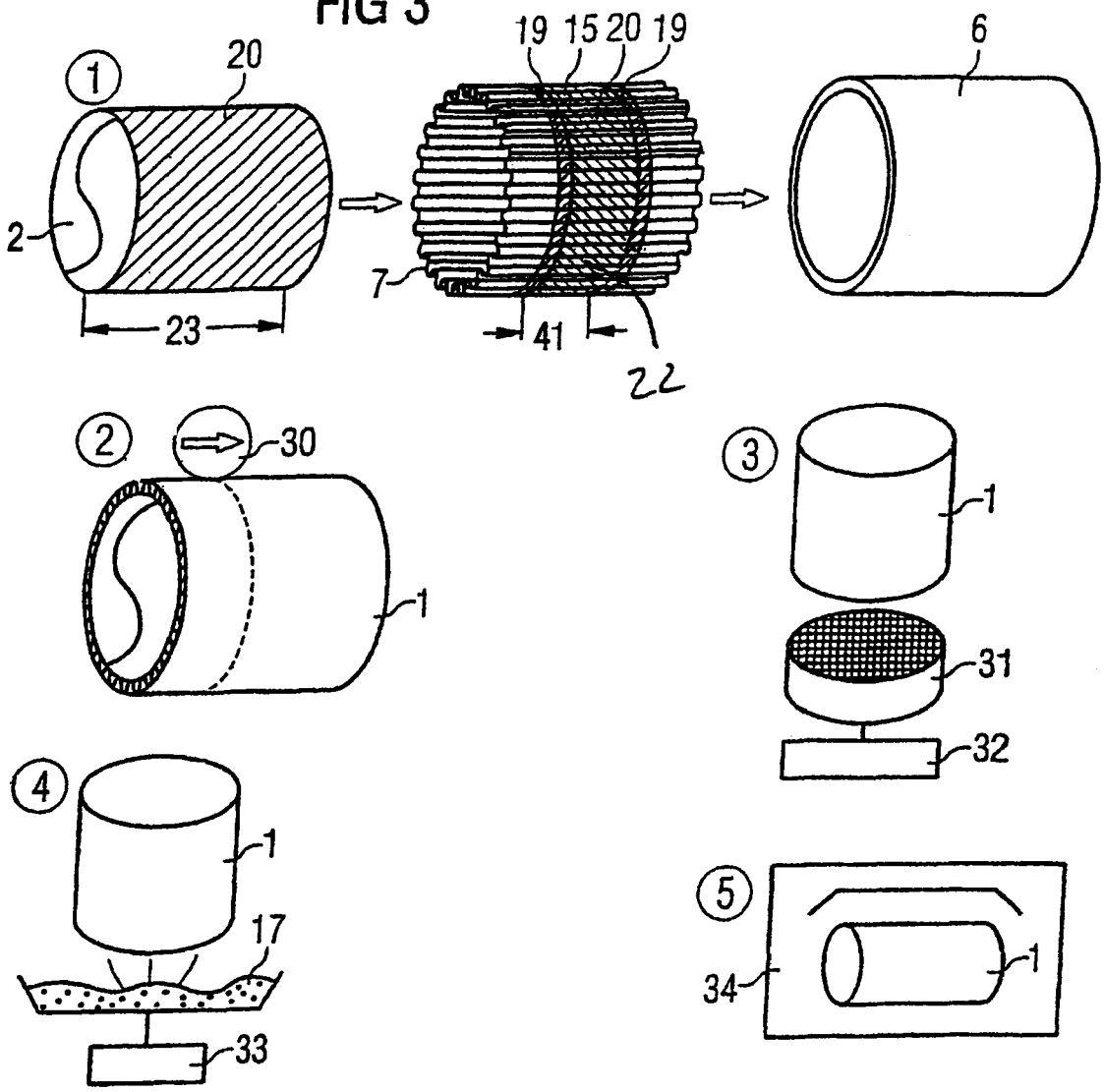
FIG. 3 is a perspective view showing a sequence of a method of manufacturing a catalyst carrier body according to the invention.

FIG. 3 shows a diagrammatic view of a sequence of an embodiment of the method according to the invention, wherein steps 1-4 are indicated by numbers in circles. In this case, a first step includes the manufacture of a honeycomb body 2, of a corrugated casing 7 and of a housing 6 which are subsequently inserted one into the other. The honeycomb body 2 has layers which are bent in an S shape and which are to be connected to the corrugated casing 7 in a coupling region 23, which includes virtually the entire external surface of the honeycomb body 2 in this case. The corrugated casing 7 already has a circumferential brazing material strip 15 on its outer side. This brazing material strip 15 is intended to bring about a connection to the housing 6 during a subsequent thermal treatment of the catalyst carrier body 1. A connecting region 22 has a width 41 and is made significantly smaller in this case than the coupling region 23 between the honeycomb body 2 and the corrugated casing 7. Two brazing regions 20 each have a defined boundary. While the coupling region 23 is bounded by the end sides 16 of the honeycomb body 2, the corrugated casing 7 has passivations 19 which defines the connecting region 22. This prevents the brazing material of the brazing material strip 15 from flowing away over the limits of the connecting region 22 when heating occurs. In this exemplary embodiment, the passivation 19 is embodied as a layer which is composed, for example, of ceramic material and/or metal-oxide-containing material. Furthermore, the passivation 19 can also be formed by microstructures or by roughening of the surface of the corrugated casing 7 and/or of the corresponding regions of the internal surface of the housing 6.

The width 41 of the connecting region 22 is determined as a function of the following parameters:

(A) external extent of the honeycomb body (6);

(B) length of the honeycomb body (6);

(C) cell density of the honeycomb body (6); and (D) layer thickness (21) of the layers (3, 4).

In this context it has proven particularly advantageous for the width 41 of the connecting region 22 or else of the brazing material strip 15 to increase monotonously with one of the parameters (A), (B), (C), (D) if the respective other three parameters remain constant. The different thermal deformations and expansions of the honeycomb bodies as a function of the parameters (A), (B), (C), (D) can thus be taken into account when configuring the width 41 of the brazing material strip 15 or of the connecting region 22.

In the second step, a common calibration of the components of the catalyst carrier body 1 is carried out. In the illustrated figure, plastic deformation of the housing 6 is carried out through the use of a tool 30 which is illustrated herein as a roller. The calibration is carried out in this case only in the region in which a corrugated casing 7 is also disposed. The calibration process itself results in a reduction in the internal contour 11 and preferably also in the profile 10 of the at least one corrugated casing 7, as a result of which at least 90% of the ends 9 of the layers bear against the structure of the corrugated casing 7.

In the third step, the catalyst carrier body 1 is placed in contact with a distributor 31, and adhesive 32 is introduced into internal regions of the honeycomb body 2 or of the catalyst carrier body 1. The adhesive 32 preferably accumulates in this case in the regions in which the layers are in contact with one another or the layers are in contact with the corrugated casing, since predominantly capillary effects bring about a uniform distribution of the adhesive 32 in this case.

In the fourth step, the brazing of the catalyst carrier body 1 at the end sides is illustrated. Brazing powder 17 enters the internal regions of the catalyst carrier body 1 through the use of a fluidized bed 33, that is to say with the support of a blower, for example. The powdery brazing material 17 remains stuck to the contact regions which are wetted with adhesive in this case.

In the fifth step, thermal treatment of the catalyst carrier body is illustrated, and the body is preferably heated in a high-temperature vacuum oven 34. When the catalyst carrier body is heated, the brazing material 17 or the brazing material strip 15 melts, and after the catalyst carrier body cools, connections between the components are generated through the use of a joining technique. A catalyst carrier body 1 which is manufactured in this way is generally subsequently provided with a support layer, impregnated with catalytically active material and used in the exhaust gas systems of different mobile internal combustion engines of passenger cars, trucks, motor bikes, lawn mowers, chain saws or the like.

Figure 4:
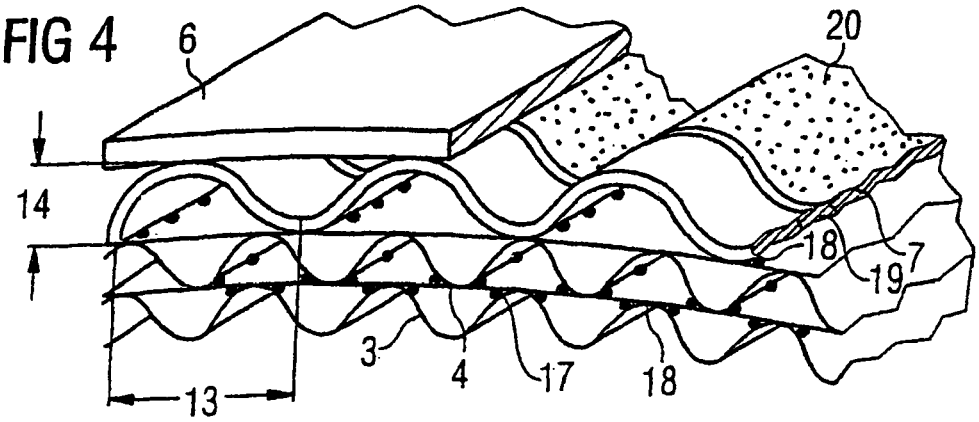
FIG. 4 is an enlarged, fragmentary, perspective view of an embodiment of the catalyst carrier body in an edge region.

FIG. 4 shows a diagrammatic and perspective view of a portion of a catalyst carrier body 1 in its edge region. Part of the housing 6 which is in contact with a corrugated casing 7 is illustrated. The corrugated casing 7 has a structure 12 which is distinguished by a structure height 14 and a structure length 13. In addition, the corrugated casing 7 has, as a passivation 19, a microstructure which, for example, prevents brazing material from flowing out of the brazing region 20 over the passivation, since the capillary effect is interrupted at this point. As a result, non-illustrated connections between the corrugated casing 7 and the housing 6 are easily and effectively avoided, outside the connecting region 22.

In the illustrated fragmentary view, the honeycomb body 2 is not bounded by non-illustrated free ends 9, but instead the corrugated layers 3 and smooth layers 4 lie substantially parallel to the corrugated casing 7. Such a configuration is obtained, for example, with layers 3, 4 which are bent in an S shape and in which the external extent of the honeycomb body is alternately bounded in the circumferential direction by ends of the layers and central regions of the layers. The layers 3, 4 bear against one another and form contact regions 18 which are subsequently used to form connections using a joining technique. After the brazing process, the pulverulent brazing material 17 is disposed in these contact regions 18. This brazing material 17 preferably sticks to an adhesive which has accumulated there.

Figure 5:
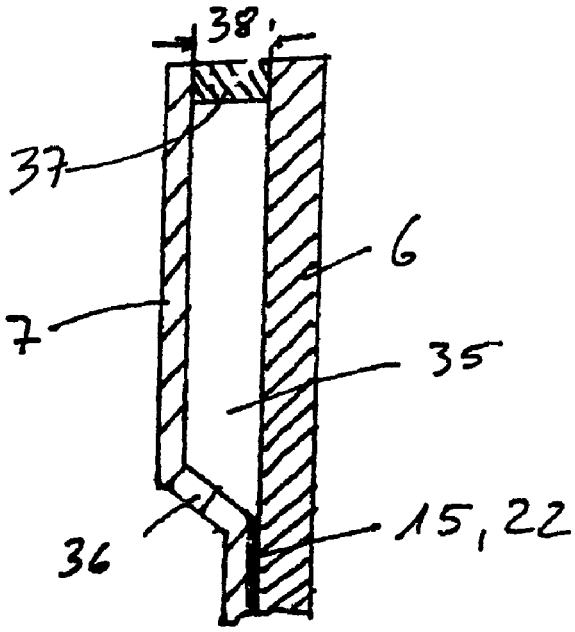
FIG. 5 is a fragmentary, axial-sectional view of a connecting region between a housing and a corrugated casing of an exemplary embodiment of the invention.
Figure 6:
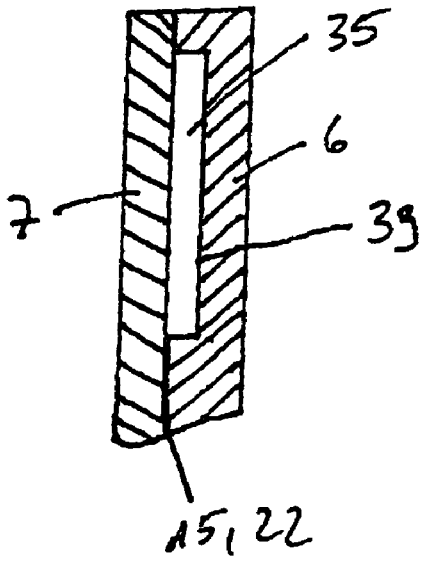
FIG. 6 is a fragmentary, sectional view of a connecting region between the housing and the corrugated casing of a further exemplary embodiment.
Figure 7:
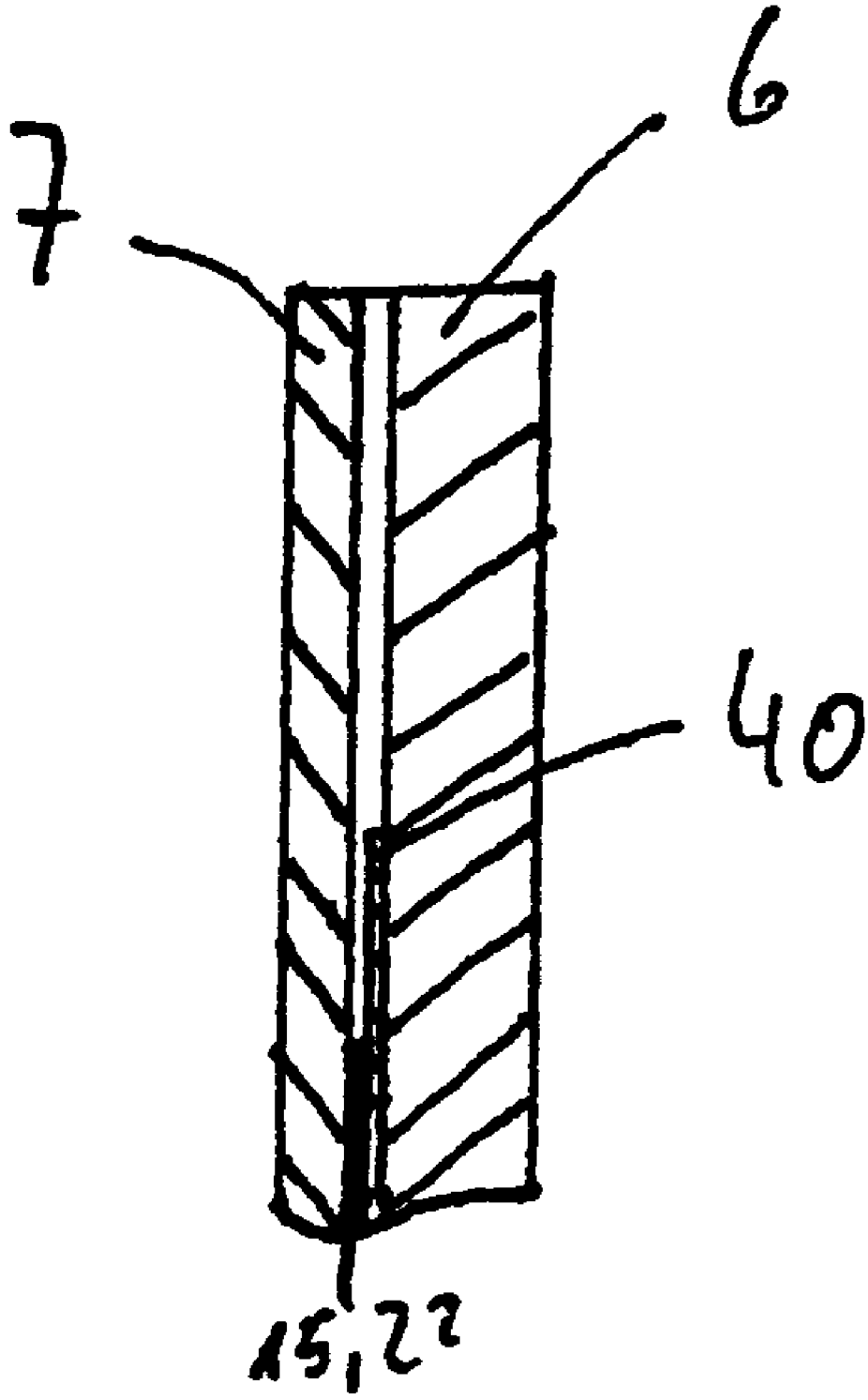
FIG. 7 is a fragmentary, sectional view of a connecting region between the housing and the corrugated casing of yet another exemplary embodiment.

Further examples of ways of forming the passivation 19 are shown in FIGS. 5 to 7. FIG. 5 shows a diagrammatic view of a portion of the housing 6 and of the corrugated casing 7 in an axial section. The corrugated casing 7 and the housing 6 are connected by a connecting region 22 which is formed by a brazing material strip 15. In this exemplary embodiment, an air gap 35 is formed as a passivation. This air gap 35 is formed by a step 36 in the corrugated casing 7. In order to prevent the corrugated casing 7 from being connected to the housing 6 in a non-uniform manner, a spacer 37 is also formed, which prevents the corrugated casing 7 from bearing obliquely against the housing 6. The spacer 37 may be embodied, for example, as a ceramic layer or a metal-oxide-containing layer. It is advantageous if the spacer 37 substantially compensates for the height 38 of the air gap 35. When the thermal treatment is carried out in order to form connections, the air gap effectively causes the capillary effect to be interrupted so that the brazing material is effectively prevented from running further.

FIG. 6 shows a further possible way of forming an air gap 35 between the housing 6 and the corrugated casing 7 as a passivation 19. The air gap 35 is formed in this case through the use of a recess 39 in the housing.

In FIG. 7, the passivation 19 is formed by a metallic foil 40. FIG. 7 only shows size ratios diagrammatically. Normally, after the calibration step, the metallic foil 40 comes to bear both against the corrugated casing 7 and against the housing 6. The metallic foil 40 partially overlaps the brazing material strip 15 so that a connection using a joining technique is formed between the metallic foil 40 and the corrugated casing 7. However, a connection using a joining technique is not formed between the metallic foil 40 and the housing 6 so that the metallic foil 40 effectively bounds the connecting region 22 and prevents further coupling of the corrugated casing 7 to the housing 6. In order to prevent a possibly undesired step from being formed it is advantageous to make the metallic foil 40 as thin as possible, preferably with a thickness of less than 50 μm, particularly preferably less than 30 μm.

The method which is described herein for manufacturing a catalyst carrier body is relatively simple and can be integrated with a high degree of processing reliability, particularly in the fabrication sequence of a series fabrication process of catalyst carrier bodies. The catalyst carrier body which results from this process is distinguished in particular by its enduring structural integrity so that this robust and stable catalyst carrier body is particularly suitable for extreme load conditions.

The invention claimed is:

1. A catalyst carrier body, comprising:

a honeycomb body having at least partially structured layers with ends, said at least partially structured layers forming channels through which a fluid can flow, said honeycomb body having an external extent being formed by a plurality of said ends of said at least partially structured layers for defining a periphery of said honeycomb body;

a housing at least partially surrounding said honeycomb body; and at least one corrugated casing disposed between said honeycomb body and said housing and connecting said honeycomb body to said housing;

at least 90% of said plurality of said ends of said at least partially structured layers being directly connected to said at least one corrugated casing by a joining technique.

2. The catalyst carrier body according to claim 1, wherein at least 95% of said ends of said at least partially structured layers are connected to said at least one corrugated casing by said joining technique.

3. The catalyst carrier body according to claim 1, wherein more than 98% of said ends of said at least partially structured layers are connected to said at least one corrugated casing by said joining technique.

4. The catalyst carrier body according to claim 1, wherein said at least partially structured layers include metallic smooth layers and corrugated layers bent in at least one of an S shape and a U shape causing all of said ends to at least partially form an external extent of said honeycomb body.

5. The catalyst carrier body according to claim 4, wherein said smooth layers and corrugated layers are disposed alternately.

6. The catalyst carrier body according to claim 1, wherein said at least partially structured layers have a layer thickness of less than 0.1 mm.

7. The catalyst carrier body according to claim 1, wherein said at least partially structured layers have a layer thickness of less than 0.05 mm.

8. The catalyst carrier body according to claim 1, wherein said at least partially structured layers have a layer thickness of less than 0.02 mm.

9. The catalyst carrier body according to claim 1, wherein said honeycomb body, said at least one corrugated casing and said housing have a cylindrical shape.

10. The catalyst carrier body according to claim 1, wherein said at least one corrugated casing and said housing define a connecting region therebetween, said at least one corrugated casing and said honeycomb body define a coupling region therebetween, and said connecting region is smaller in area than said coupling region.

11. The catalyst carrier body according to claim 10, wherein said connecting region and said coupling region at least partially overlap.

12. The catalyst carrier body according to claim 10, wherein said connecting region is bounded axially by an air gap.

13. The catalyst carrier body according to claim 12, wherein said air gap is formed by at least one of a recess in said housing and a step in said at least one corrugated casing.

14. The catalyst carrier body according to claim 13, which further comprises a spacer disposed between said housing and said at least one corrugated casing.

15. The catalyst carrier body according to claim 1, wherein said at least partially structured layers have a layer thickness, said at least one corrugated casing has a casing thickness, said housing has a housing thickness, and said casing thickness lies, in terms of size, between said layer thickness and said housing thickness.

16. The catalyst carrier body according to claim 15, wherein said casing thickness lies in a range from 0.08 mm to 0.25 mm.

17. The catalyst carrier body according to claim 1, wherein said honeycomb body has a length, in a direction of an axis, corresponding to an extent of said at least one corrugated casing, in said direction of said axis.

18. The catalyst carrier body according to claim 1, wherein said at least one corrugated casing has a structure length and a structure height, said structure length lies in a range from 1.5 mm to 3.5 mm, and said structure height is 0.3 mm to 1.0 mm.

* * * * *